United States Patent [19]

Hunter et al.

[11] 4,106,474

[45] Aug. 15, 1978

[54] HEAT CONSERVING SPACE HEATER

[75] Inventors: Robert L. Hunter; Everett L. Sartain, both of Racine, Wis.

[73] Assignee: Modine Manufacturing Company, Racine, Wis.

[21] Appl. No.: 778,367

[22] Filed: Mar. 17, 1977

[51] Int. Cl.[2] ..... F24H 3/100

[52] U.S. Cl. ..... 126/110 R; 165/DIG. 2

[58] Field of Search ..... 165/DIG. 2; 126/110 R, 126/110 B, 116 R

[56] References Cited

U.S. PATENT DOCUMENTS

| | | | |
|---|---|---|---|
| 2,225,181 | 12/1940 | Powers | 126/110 R |
| 2,470,860 | 5/1949 | Parrish | 126/110 R X |
| 2,751,900 | 6/1956 | Modine | 126/110 B |
| 3,241,544 | 3/1966 | Lohman | 126/110 B X |
| 3,650,262 | 3/1972 | Root et al. | 126/110 R |
| 3,981,291 | 9/1976 | Smith | 126/110 R |
| 4,007,726 | 2/1977 | Kenchel | 126/110 B X |
| 4,034,482 | 7/1977 | Briscoe | 165/DIG. 2 X |

*Primary Examiner*—William E. Wayner
*Assistant Examiner*—William E. Tapolcai, Jr.
*Attorney, Agent, or Firm*—Wegner, Stellman, McCord, Wiles & Wood

[57] ABSTRACT

The invention is a heat conserving space heater that includes a heat source for providing a supply of hot gas of which an example is a gas fired unit heater, air passages in the heater with means for drawing air from the space and exhausting it into the space and when passing through the heater being in heat exchange relationship with the hot gas passages in the heater and an auxiliary heat conserving heat exchanger downstream from the hot gas and air passages and having auxiliary hot gas passages and auxiliary air passages in heat exchange relationship with each other and means in the auxiliary heat exchanger for forcing the hot gas in series through the hot gas passages of the unit heater and through the auxiliary hot gas passages and from there to a place of disposal. The heat conserving space heater also includes means for drawing air from the space, through the air passages in the unit heater, through the auxiliary air passages that are in the heat exchange relationship with the auxiliary hot gas passages in the heat conserving heat exchanger and then forcing the thusly heated air back into the space.

5 Claims, 3 Drawing Figures

HEAT CONSERVING SPACE HEATER

BACKGROUND OF THE INVENTION

One of the features of this invention is to provide a heat conserving space heater that provides additional hot gas passages and space air passages downstream of the corresponding passages in a unit space heater so as to extract the additional heat from the hot gas of the unit heater before expelling these gases to a place of disposal such as through a flue pipe.

DESCRIPTION OF THE PREFERRED EMBODIMENT

Figure 1:
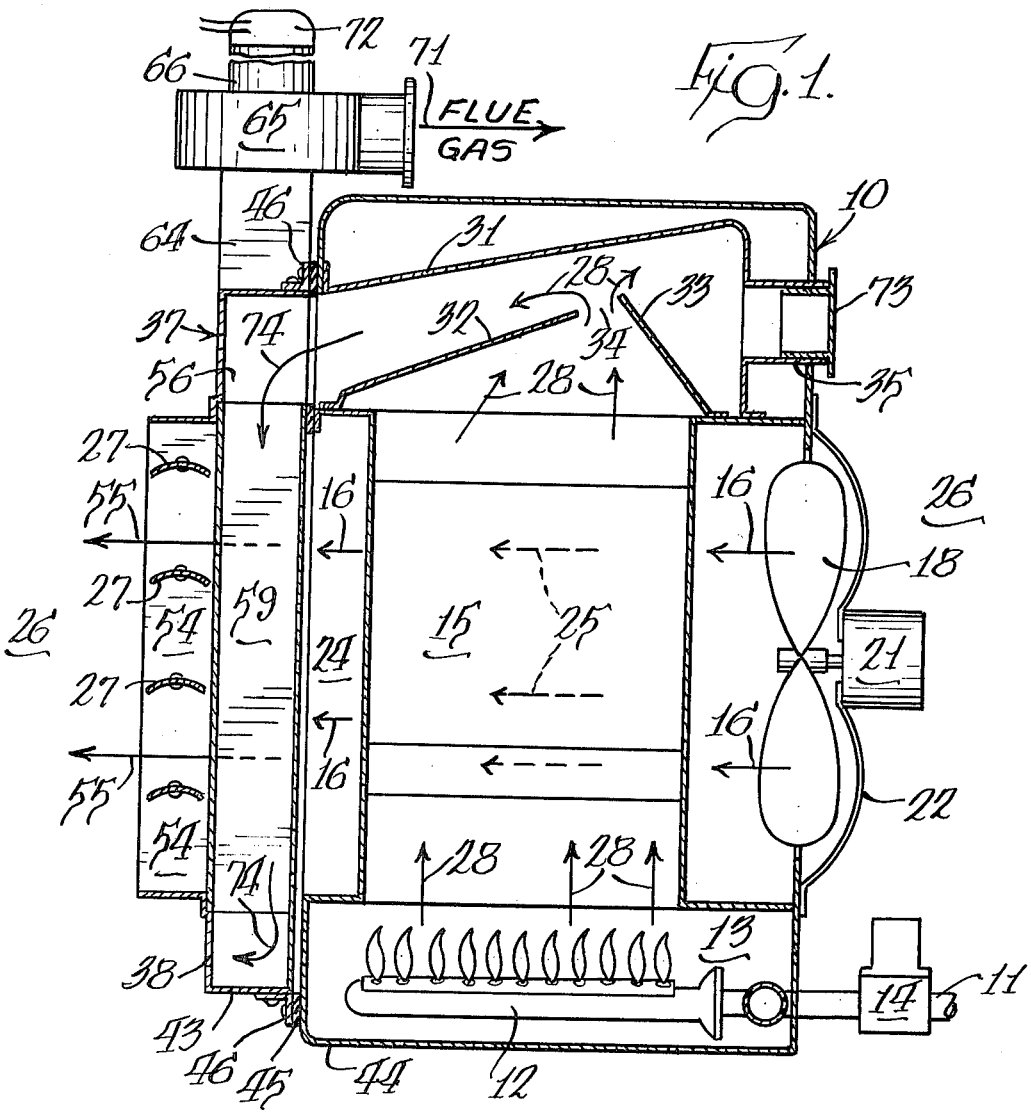
FIG. 1 is a vertical sectional view through the heat conserving space heater embodying the invention and taken substantially along line 1—1 of FIG. 3.

In the sectional view of FIG. 1 there is shown a conventional space unit heater 10 that is gas fired by gas supplied through a gas line 11 to a burner structure 12 housed in a bottom burner box 13. In the gas line 11 there is provided a conventional control box 14 which houses a conventional control valve with pilot light control, limit control, relay and similar types of controls (not shown) to insure troublefree operation of the heater.

Extending vertically and in communication at their bottoms with the burner box 13 are spaced vertical flues 15 that are spaced horizontally from each other to provide flat passages 17 for the flow of space air 16. This space air is customarily forced through the air passages 17 by a rear fan 18 that is rotated by an electric motor 21 with the fan 18 and motor 21 assembly being mounted on an open spider 22 at this rear 23 of the unit heater 10.

Located at the front of the heater 10 is a flat vertically arranged chamber 24 that receives the parallel flow of heated space air 16 for expelling the resulting heated air 25 back into the space 26. As is customary in the conventional unit heater 10, there are provided vertically spaced flow directing vanes 27 for directing the heated air 25 either upwardly or downwardly at a desired angle.

In this customary unit heater 10 the gases 28 from the vertical flues 15 pass upwardly into an outlet header 31. This header 31 is separated into an upper part and lower part by baffles 32 and 33 having their inner edges spaced from each other to provide a flow opening 34 for the gases 28. This upper part of the header 31 is provided with a customary flue pipe 35 for conducting the combustion product gases 28 to a customary place of disposal such as into the atmosphere. As is customary, the front of the header 31 is normally open as shown at 41 (FIG. 3) for drawing in space air 26 which is then mixed with the gases 28 before exhausting from the normal unit heater 10 through the flue pipe 35.

Figure 3:
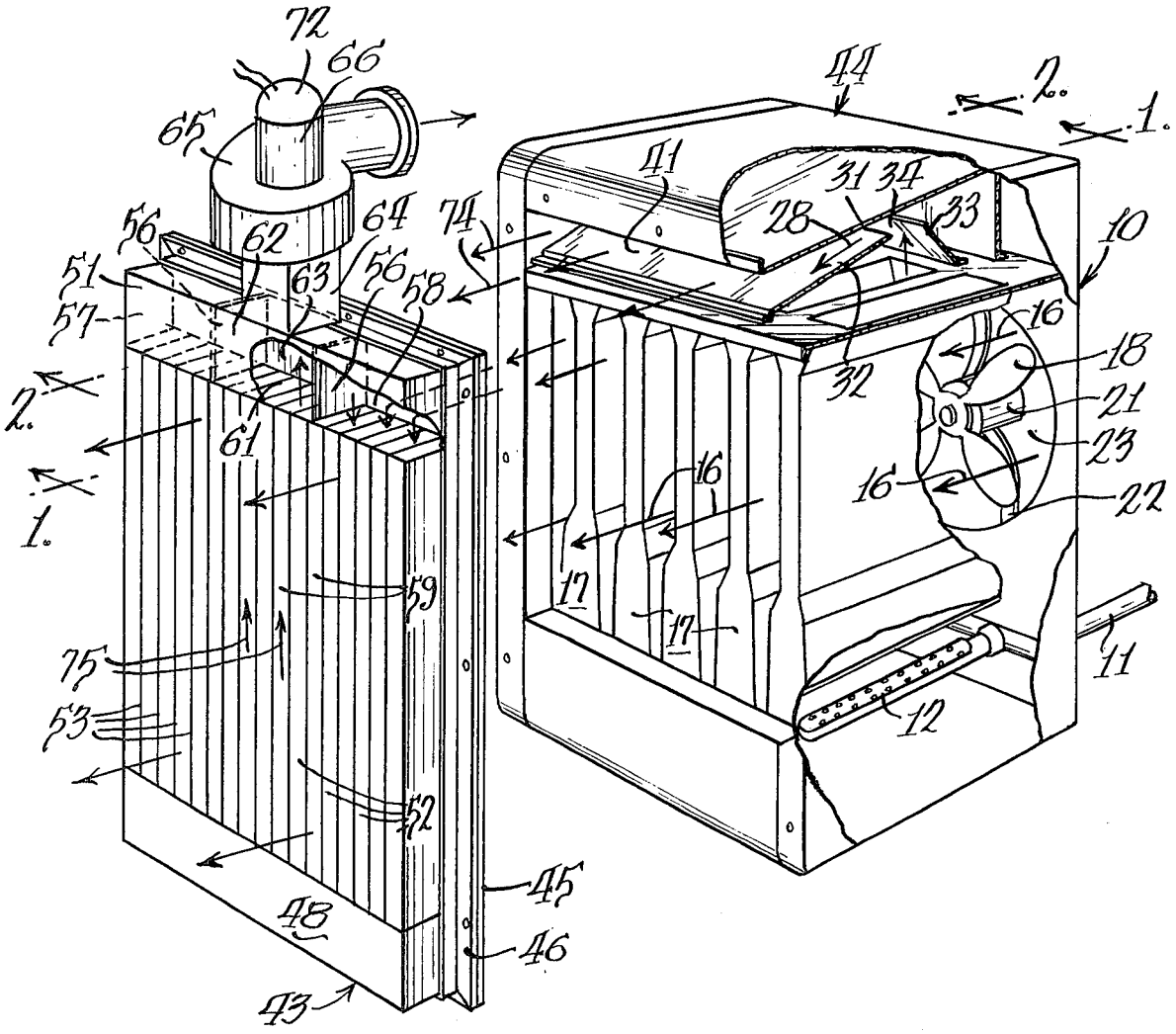
FIG. 3 is an exploded perspective view partially broken away of the unit space heater and auxiliary heat exchanger which combined comprise the illustrated embodiment of this invention.

In this invention the heat conserving space heater 37 includes the unit heater 10 as described above and has attached thereto an auxiliary heat conserving heat exchanger 38 illustrated in detail at the left end of FIG. 3. This auxiliary heat exchanger comprises an add-on unit which comprises a cabinet 43 for attaching to the front of the cabinet 44 that forms a part of the unit heater 10 and is sealed thereto by intervening sealing gaskets illustrated at 45. The auxiliary cabinet 43 is provided with edge flanges 46 for attaching to the cabinet of the unit heat exchanger 10 with the sealing gaskets 45 therebetween.

The auxiliary heat exchanger 38 is of generally rectangular shape and has a bottom transverse chamber 48 and a top transverse chamber 51 connected by vertical air passages 52 that are defined by spaced vertical baffles 53. These vertical passages 52 may if desired contain serpentine heat transfer fins but such is not required and therefore are not shown.

The passages 52 are arranged in communication with the front chamber 24 of the unit heater 10 so as to receive heated space air 16 therefrom and the front of the heat exchanger is provided with a vertical chamber 54 open at front and back for passage of heated air 25 from the auxiliary air passages 52 into the space 26 as illustrated by the arrows 55. This chamber 54 now contains the angularly adjustable flow directing horizontal vanes 27.

The top chamber 51 on the auxiliary heat exchanger is divided into three sections by a pair of spaced vertical baffles 56, two of the spaces 57 and 58 are at the lateral sides of the heat exchanger 38 while a third space 61 is at the center. The front and rear of the center space 61 are closed by plates 62 and 63 while the rear of each of the end spaces 57 and 58 are open to receive hot gas flow from the header 31.

The passages 52 for the air are interleaved with alternate hot gas passages 59 that receive hot gas from the header 31 for flow through the auxiliary heat exchanger.

Figure 2:
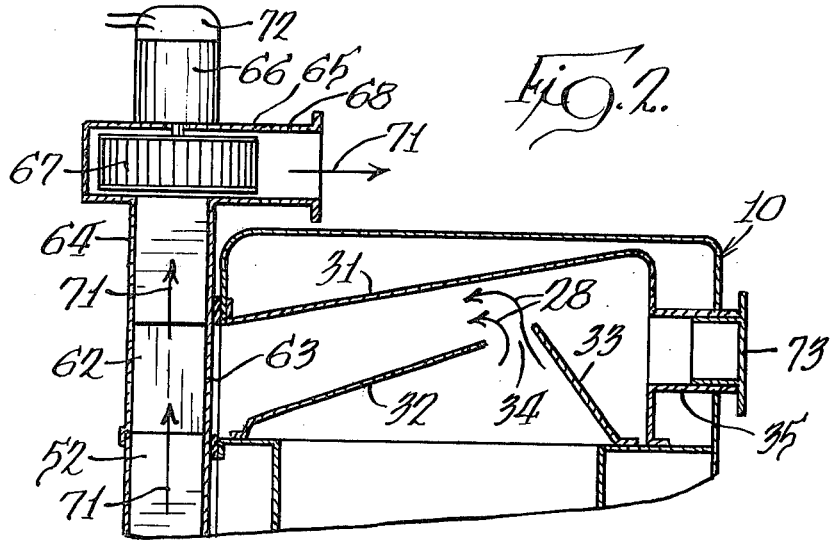
FIG. 2 is a fragmentary top sectional view of FIG. 1 with additional portions in section and taken substantially along line 2—2 of FIG. 3.

Mounted on the top of the auxiliary heat exchanger 38 is a short upward extending duct 64 leading to a blower chamber 65 on top of which is positioned an electric motor 66 for driving a rotatable blower 67 located in the chamber 65 (FIG. 2). This blower 67 exhausts the combustion product gases through an exhaust outlet 68 to a place of disposal as indicated by the arrow 71.

Positioned on top of the motor 66 in this embodiment is a housing 72 in which is located the safety control of the customary type which is required by the American Gas Association and which insures that the gas supply line not be turned on through the pipe 12 by a control valve in the box 14 until the blower 67 is operating at a selected minimum speed such as to prevent gas leakage into the space 26.

When the auxiliary heat exchanger is assembled with the unit heater 10 the customary exhaust 35 from the unit 10 is plugged as with a closure 73 because now the exhaust is taken care of by the front blower structure 64–68.

In operation the unit heater 10 heats the space air 26 in the customary manner except now instead of this space air being passed back into the space 16 the hot gases 28 are directed upwardly into the header 31, forwardly into the end chambers 57 and 58 at the top of the heat exchanger, then downwardly through the end hot gas passages 59 as indicated at 74 and then upwardly through the intermediate passages as indicated by the arrows 75 into the central chamber 63 at the top. From the central chamber 63 the gases are drawn through the short duct 64 into the blower chamber 65 by the blower 67 and exhausted through the exhaust outlet 68.

In the meantime the heated air 16 from the space 26 is directed through the alternate passages 52 which are interleaved with the gas passages 59 so as to extract heat from the combustion gases in these passages 52. This air 55 is then passed back into the space 26 by way of the chamber 54.

The auxiliary add-on unit of this invention and the unit heater 10 together comprise the heat conserving space heater which greatly conserves heat as it extracts more of the heat from the combustion gases before expelling these gases to a place of disposal. Thus in one embodiment the gases 28 from the burner box 13 which would normally be exhausted to ambient atmosphere as waste gases were at a temperature of about 500°F. With this invention much of this heat was conserved so that the exhaust gases 71 instead of being at 500°F. were only at 200°F. or less.

Having described our invention as related to the embodiment shown in the accompanying drawings, it is our intention that the invention be not limited by any of the details of description, unless otherwise specified, but rather be construed broadly within its spirit and scope as set out in the appended claims.

We claim:

1. A heat conserving space heater, comprising: (A) a gas fired unit heater having a heat source means for providing a supply of hot gas, main hot gas passages leading from said source, and main air passages leading from and exhausting into the space being heated and in heat exchange relationship with said main hot gas passages; and (B) an auxiliary add-on heat conserving heat exchanger unit attached to said unit heater and having in heat exchange relationship with each other a set of auxiliary hot gas passages receiving hot gas from said main hot gas passages and a set of auxiliary air passages receiving heated air from said main passages, and an exhaust blower on said add-on unit for drawing said hot gas through said main hot gas passages on the unit heater, then through said auxiliary hot gas passages of said add-on unit and then for exhausting said hot gases from said auxiliary passages to a place of disposal, said unit heater including a cabinet, and seal means between the unit and add-on heaters for aid in defining and separating the combination of main hot gas passages and auxiliary hot gas passages from the main and auxiliary air passages.

2. A heat conserving space heater, comprising: (A) a gas fired unit heater having a heat source means for providing a supply of hot gas, main hot gas passages leading from said source, and main air passages leading from and exhausting into the space being heated and in heat exchange relationship with said main hot gas passages; and (B) an auxiliary add-on heat conserving heat exchanger unit attached to said unit heater and having in heat exchange relationship with each other a set of auxiliary hot gas passages receiving hot gas from said main hot gas passages and a set of auxiliary air passages receiving heated air from said main passages, and an exhaust blower on said add-on unit for drawing said hot gas through said main hot gas passages on the unit heater, then through said auxiliary hot gas passages of said add-on unit and then for exhausting said hot gases from said auxiliary passages to a place of disposal, said auxiliary air passages in said add-on unit being arranged for parallel air flow and said auxiliary gas passages in said add-on unit being also arranged for parallel flow with the auxiliary air and gas passages being alternately interleaved, said auxiliary gas passages being arranged in said add-on unit in a plurality of back and forth sets extending substantially through the length and width of said add-on unit.

3. A heat conserving space heater, comprising: (A) a gas fired unit heater having a heat source means for providing a supply of hot gas, main hot gas passages leading from said source, and main air passages leading from and exhausting into the space being heated and in heat exchange relationship with said main hot gas passages; and (B) an auxiliary add-on heat conserving heat exchanger unit attached to said unit heater and having in heat exchange relationship with each other a set of auxiliary hot gas passages receiving hot gas from said main hot gas passages and a set of auxiliary air passages receiving heated air from said main passages, and an exhaust blower on said add-on unit for drawing said hot gas through said main hot gas passages on the unit heater, then through said auxiliary hot gas passages of said add-on unit and then for exhausting said hot gases from said auxiliary passages to a place of disposal, said unit heater including a cabinet, said add-on heater also including a cabinet, there are provided seal means between the unit and add-on heaters for aid in defining and separating the combination of main hot gas passages and auxiliary hot gas passages from the main and auxiliary air passages, said add-on heater including an outlet duct forming a part of said auxiliary air passages and provided with adjustable flow directing vanes for directing the resulting heated air from said add-on heater to the space being heated, and said auxiliary air passages in said add-on unit being arranged for parallel air flow and said auxiliary gas passages in said add-on unit being also arranged for parallel flow with the auxiliary air and gas passages being alternately interleaved.

4. The space heater of claim 3 wherein means are provided on said add-on unit for preventing gas flow to said unit heater unless the exhaust blower is operating, the blower when inoperative serving as a damper substantially to prevent escape of room air through the space heater and add-on unit to said place of disposal.

5. The space heater of claim 3 wherein said auxiliary gas passages are arranged in said add-on unit in a plurality of back and forth sets extending substantially through the length and width of said add-on unit.

* * * * *